US005762281A

United States Patent [19]

Foley

[11] Patent Number: 5,762,281

[45] Date of Patent: Jun. 9, 1998

[54] AUTOMATICALLY LOADING CORD WINDER APPARATUS AND METHOD

[76] Inventor: Michael Foley, 8316 Bob-O-Link Dr., West Plam Beach, Fla. 33412

[21] Appl. No.: 801,971

[22] Filed: Feb. 18, 1997

[51] Int. Cl.[6] ..... B65H 75/48

[52] U.S. Cl. ..... 242/376; 242/385.2; 160/178.1

[58] Field of Search ..... 242/376, 385, 242/385.4; 160/170, 178.1

[56] References Cited

U.S. PATENT DOCUMENTS

| | | | |
|---|---|---|---|
| 898,083 | 9/1908 | Amstalden . | |
| 1,182,261 | 5/1916 | Foothorap | 242/376 |
| 2,565,339 | 8/1951 | Anderson . | |
| 2,678,779 | 5/1954 | Bellmer . | |
| 3,809,331 | 5/1974 | Gaul . | |
| 4,271,893 | 6/1981 | McCluskey . | |
| 4,466,581 | 8/1984 | Hill . | |
| 4,726,536 | 2/1988 | Lerner . | |
| 4,773,623 | 9/1988 | Nabinger | 242/385.4 |
| 4,802,638 | 2/1989 | Burger . | |
| 4,901,938 | 2/1990 | Cantley et al. | 242/385.4 |
| 4,909,298 | 3/1990 | Langhart . | |
| 4,989,805 | 2/1991 | Burke . | |
| 5,094,396 | 3/1992 | Burke . | |
| 5,279,473 | 1/1994 | Rozon . | |
| 5,354,011 | 10/1994 | Rozon . | |
| 5,630,456 | 5/1997 | Hugo et al. | 242/395 |

*Primary Examiner*—John P. Darling
*Attorney, Agent, or Firm*—McHale & Slavin

[57] ABSTRACT

An automatically loading cord reel device which includes a cord reel housing, a rotatably contained spool with indexing slots, and a coiled spring which is coupled to said spool. A spring loaded indexing lever interacts with the indexing slots on the spool. The spool is pre-wound a fixed number of turns and the pre-wound device includes an exposed portion of a cord attachment device which is attached to the spool and extends out from a cord reeling aperture in the reel housing. The embodied cord attachment device includes a tongue-shaped strip of flexible material with an circular aperture and connected distally extending slot formed therethrough the exposed end portion of the tongue. A locking pin aperture also extends through the exposed portion of the tongue for receiving a locking pin. The pre-wound spool is thereby held in place by the locking pin to prevent unwinding. To use the device, knotted cords are placed through the readily accessible exposed cord attachment aperture and distally slid into the slot. Upon removal of the locking pin, the cords are automatically reeled inside the device to a pre-determined and/or indexably controlled length.

17 Claims, 3 Drawing Sheets

AUTOMATICALLY LOADING CORD WINDER APPARATUS AND METHOD

FIELD OF INVENTION

This invention relates to an apparatus and method for automatically loading and winding cord into a reeling device for winding and conveniently storing the excess cord from an appliance such as a window shade, blind or other corded appliance. The apparatus provides convenient and automatic loading of the cord through a pre-wound winding fixture and cord attachment tongue with a removable locking bar.

BACKGROUND OF THE INVENTION

A large variety of window treatment products exist which use control lines in order to facilitate opening and closing of the window treatment. Such control lines typically consist of at least two cords which hang down from a control mechanism mounted along the top of the window. A typical window treatment product is known as a blind which usually includes a number of slats rotatably controlled by a control mechanism. When the cords are pulled, the blinds are drawn upward or sideways and the excess cord produced by the pulling action collects below the blind retraction mechanism. This excess cord presents a problem in that it might tangle and thereby prevent proper operation of the window blind. Additionally, children or animals might become tangled in the excess cord and such entanglement might cause injury or even death through, for instance, strangulation or hanging.

A number of prior art patents have addressed the problem of cord retraction and cord storage. Such devices, however, do not disclose a convenient apparatus and method for initially loading the cords into the reeling device. For window blind applications, such cord reeling devices will often be purchased and used by non-mechanically oriented people. Prior art devices presently require disassembly of the reeling units in order to feed or tie the cords onto the winding spools or hubs. This difficult initial task will often dissuade a person from purchasing or using a cord reeling device altogether. Hence the excess window cord will be left in an unsightly and often dangerous position.

Telephones and electrical appliances similarly present an excess cord problem which might be cumbersome or dangerous for users of such appliances. Prior art electrical and telephonic cord reel devices include U.S. Pat. Nos. 898,083; 2,565,339; 2,678,779; 3,809,331; 4,466,581; 4,726,536; 4,802,638; 4,901,938; 4,989,805; and 5,094,396. In each such reeling device the cord is either contained within the reel when acquired, or the cord is fed into the device for winding by the user. To feed the cord into the device, a portion of the reeling device housing must be disassembled or removed and the cord must be wrapped or threaded around a spool or hub. None of the cited devices disclose a pre-wound cord reel that automatically coils excess cord without the user having to disassemble and thread the cord onto a spool or hub. As a result, the prior art electrical and telephonic cord devices are difficult to use and not easily adaptable to other applications such as window blind cords.

As applied to window blinds, U.S. Pat. No. 4,271,893 ('893) discloses a cord collector which contains multiple spools for winding respective cords on the separate spools. The apparatus includes a guide, or comb, to be mounted in the headrail of the window blind which serves to steer the individual cords towards their respective spools. The cords are then tied or attached to each spool and a coil spring biases the cords in a wound position.

U.S. Pat. No. 4,909,298 ('298) discloses a window covering pull cord safety device. This device employs a first and second cord attachment member which are secured to the individual cords of a blind. The members are detachably connected so that the looped arrangement of the cords will be broken upon the application of force. Winding of the cord is accomplished manually by wrapping the cord around the joined members which then fit over a mount on the window blind headrail.

U.S. Pat. No. 5,279,473 ('473) discloses a cord retraction device specifically adapted for use with window blinds. The device discloses a cord attachment member which is adapted to engage a loop formed by the cord so that the loop is free to slide through the member when the cord is in the unretracted position. An access door must be open and the cord attachment member removed from its mounting fixture on the spool. The attachment member then clips back onto a take up spool and the spool is manually wound to a sprung position to load the device. Thereafter the access door must be re-closed and secured into place to use the device.

U.S. Pat. No. 5,354,011 ('011) discloses a take-up reel for window blind cords which includes a rotatably driven spool with a cord attachment member fixedly engaged to the spool. The attachment member consists of a post extending from the spool and a loop formed by the cord is placed over the post so that it can slide when the cord is in its unretracted position. To attach the loop, the cord is fed in through the top of the device, and an access panel is removed from the side. When the loop is placed over the post, the spool is manually wound into position to retract and complete the loading of the cord into device. The access panel must then be re-attached to the side in order to safely and properly use the cord reeling device.

For these latter window blind cord devices, the art fails to disclose an apparatus and method for automatic loading of window blind or other such cords into the reeling mechanism and onto the spools or hubs. In each instance, the loading process is difficult to accomplish, particularly when the device uses multiple spools or reels as in '893, and/or disassembly and access procedures as in '473 or '011. Moreover, such prior devices require manual winding of the spool by the user prior to cord being attached. Such winding is accomplished by either partially or fully disassembling the cording winding unit, connecting or tying the cord to an inner spooling unit or fixture, and then reassembling the cord winding unit.

Accordingly, what is needed in the field is an automatic cord reeling device and method for loading and winding a cord onto a pre-wound reel which does not require disassembly or removal of any parts in order to connect and subsequently wind the cord. The device would be used thereafter to take-in and reel-out cord as needed when operating a product having excess cord extending therefrom which needs to be retracted and stored, such as a window blind.

SUMMARY OF THE INVENTION

The present invention provides a cord retraction device and method for automatic loading and winding of a cord within a reeling mechanism. In particular, the present invention is well suited for use as a window blind cord reeling mechanism. The device includes a reel housing which contains a spring-loaded spool or hub rotatably mounted therein. The reel housing also includes a cord reeling aperture formed in the upper side. The spring consists of a coil of flexible material, such as metal or steel, which is rotated to store potential energy. The spool has a ratcheted edge which is indexably stopped with a spring-loaded indexing lever which is slidably mounted in the housing and controlled by the user.

The device also includes a specially formed tongue with an attachment fixture at one end which fits into a corresponding receptacle on the spool. The remainder of the tongue is flat and includes a cord receiving aperture through its side used to receivably attach a cord or set of cords. The aperture is elongated with a large circular opening which tapers down to a slot extending towards the free end of the tongue. The slot includes serrations to frictionally engage the knotted cords. The tongue also includes a locking pin aperture located between the cord receiving aperture and the attachment end.

The spool is pre-wound a fixed number of turns to a known tension via, for instance, an indexed drill or winding mechanism. The tongue is positioned so that the locking pin aperture and cord receiving aperture on the tongue both extend out from the cord reeling aperture in the reel housing. The spring-loaded indexing lever is biased inward to engage the spool and arrest any unwinding rotation of the spool. The prevent any accidental retraction of the exposed tongue before it is properly loaded with a cord, the spring-loaded, pre-wound spool is thereafter locked or held into place by inserting a locking pin through the locking pin aperture. The pin spans the cord reeling aperture in the cord reel housing and thereby prevents the tongue from being pulled back into the cord reel housing by the spring bias exerted on the pre-wound spool. The pin might additionally be taped down and appropriately labeled to prevent unwanted removal of the pin until the user actually intends to attach and retract a cord into the cord winding device. The cords of a window blind are typically encased or tied to a plastic knob or appendage. In order to use the present invention, the cords are freed from such knobs and a knot is tied in the end of the cord combination. The knot is then passed through the circular cord receiving aperture in the tongue. Each knotted cord is slid distally along and into the slot towards the free end of the tongue. Since the knot at the end of the cord cannot fit through the narrow slot, each cord is receivably held by the tongue. The serrations in the slot serve to prevent the cord from sliding back out towards the cord receiving aperture. Such placement of the cords in the tongue is easy to accomplish and takes very little time or skill as compared to the prior art.

Once the cords are in place, the locking pin is removed, and this allows the spring-loaded spool to retract into tongue. The indexing lever is spring-biased to engage the ratchets on the spool; when the lever is retracted by the user against the spring action, the spool is free to spin and the pre-wound tension serves to retract the cords onto the spool and into the reeling device through the cord reeling aperture. Once the desired length of exposed cord remains, the user can re-deploy the indexing lever to stop the rotation of the spool. To make subsequent adjustments, the lever is retracted and the cord reeling device is moved along the length of hanging cord to provide a desired length of exposed cord. The automatic cord loading capabilities of the present device might also be used for other applications besides window blinds or shutters.

It is therefore an object of the present invention to provide a pre-wound cord retraction device which receives and automatically retracts a cord or cords into the device, and provides for adjustment thereafter.

It is a related object of the present invention to provide a cord retraction device with a cord receiving tongue attached to the inner cord spool and oriented to extend from the cord retraction device housing when the spool is pre-wound.

It is still another object of the present invention to provide a cord retraction device with the cord receiving tongue having a cord receiving aperture for slidably receiving knotted cords, and a locking pin aperture for receiving a locking pin which holds the spool into its pre-wound position.

It is yet another object of the present invention to provide a cord retraction device where the cord receiving aperture is shaped with a large circular opening and an adjoining serrated slot, with the knotted cords placed into the aperture and slidably trapped by the slot.

It is a further object of the present invention to provide a method of operation whereby the knotted cords are placed into the tongue of the pre-wound device and the locking pin is removed to thereby allow automatic retraction of the cords to a user controlled length inside the cord retraction device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
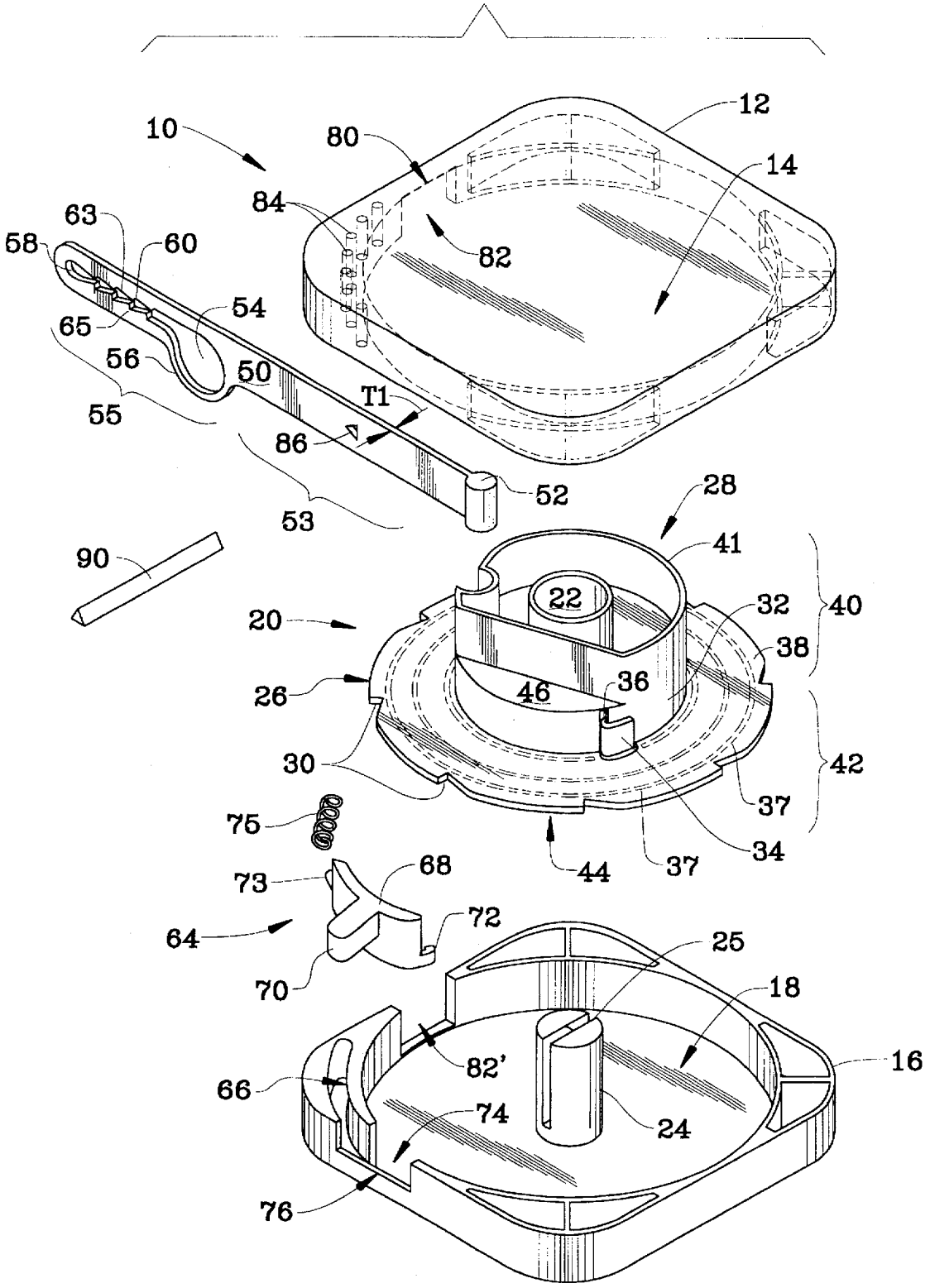
FIG. 1 is an exploded perspective view of the component parts of the automatic cord reeling device.

Referring now to FIG. 1, an exploded view of the component parts of the automatic reeling device 10 of the instant invention are shown. A upper housing half 12 includes an inner circular cavity 14. A corresponding lower housing half 16 includes a corresponding inner circular cavity 18. An inner spool 20 is shown with a centralized hub 28 having an upper end 40 and lower end 42. The lower end 42 includes an enlarged disk 26 which extends circumferentially out from the bottom of the hub 28. The disk 26 includes an outer face 44 and an inner face 38. An aperture 22 runs through the center of the hub 28. The aperture 22 fits over a spindle 24 which extends up from the center of cavity 18 on lower housing half 16. The disk 26 includes ratcheted slots 30 around its circumference and the disk 26 is oriented so that the outer face 44 fits flush against the cavity 18 formed in the lower housing 16.

In the middle portion of the disk 26, a cylindrical cavity 32 (See FIG. 4) is formed to extend up through the hub 28, and the cavity 32 receivably contains a coiled spring 34 which is preferably made from steel or the like strong and flexible material. The spring 34 is folded back and a first end extends through slot 36 which anchors the spring 34 to the spool 20. The opposite, free end of the coiled spring 34 is bent inward across the central portion of the cavity 32 and extends across the aperture 22. The spindle 24 includes a bifurcating slot 25 for receivably attaching the free end 27 of the spring 34 (See FIG. 4) as the spool 20 is placed into the lower cavity 18. The spool 20 is thereafter free to spin with a clockwise motion which winds the spring 34.

The hub 28 includes a "D"-shaped wall 41 about its upper end 40, with a ledge 46 formed on the hub along the flat portion of the wall 41. A receiving aperture 62 is formed inside the "D"-shaped wall for placement of a flexible cord receiving tongue 50. The cord receiving tongue 50 is attached to the spool 20 and includes a mounting fixture 52 at its proximal end 53 and a cord receiving aperture 54 at its distal end 55. The aperture 54 is circular in shape is formed within by the tab shaped appendage 56 on the distal end 55 of the tongue 50. A slot 58 extends distally from the aperture 54 and includes a serrated edge 60 along each inner side 63, 65 of the slot 58. The proximal end 53 includes an attachment fixture 52 that fits within the receiving aperture 62 to frictionally fit the tongue 50 to the spool 20. The tongue 50 might also be more permanently secured to the spool 20 with an adhesive such as glue or epoxy. Proximal end 53 also includes the locking pin aperture 86, which is triangular in shape. Locking pin 90 and locking pin aperture 86 might also effectively include other cross-sectional shapes such as hexagonal, circular or square. Tongue 50 can be any reasonable thickness T1, and formed from any flexible and strong material. The preferred embodiment, however, uses a nylon tongue approximately 0.025 inches thick.

The cord reeling device 10 also includes a sliding lever 64. The lever 64 has an arcuate-shaped body 68 and a handle 70. The Lever 64 slidably fits within a conforming slot 66 located in one corner of the lower housing half 16. A pawl 72 on the lever 64 extends into the lower cavity 18 through an opening 74 in the side of the slot 66. Post 73 extends from the opposite end of the lever 64 and receives the end of a spring 75 which is placed in the slot 66. The spring 75 serves to bias the lever 64 so that the pawl 72 extends into the cavity 18, for deploying the lever. An aperture 76 for the lever handle 70 leads from the slot 66 through to the outer surface of the lower housing half 16. The lever handle 70 projects through the aperture 76, and the aperture 76 is wide enough so that the handle 70 can be used to slide the lever 64 back and forth within the slot 66, with the lever 64 springably biased in one direction. The corner of the upper housing half 12 adjoining the slot 66 includes a semi-solid structure or frame to assist in holding the lever 64 in the slot 66. In this embodiment, the structure is includes of a series of holes 84 which prevents binding of the moving parts, and alleviates a solid, heavy structure in the corner.

When the spool 20 is placed within the lower cavity 18, it is free to rotate, as biased in one direction by the spring 34. The pawl 72, however, extends into the lower cavity 18 and interacts with the ratcheted slots 30. The pawl 72 and slots 30 are oriented to hook with each other to stop the spool 20 from rotating in a counter-clockwise direction, whereas the ramp-shape of the slots 30 allows free rotation in a clockwise direction. Hence, as the cords are forcibly withdrawn from the cord reeling device 10, the spool 20 freely spins in a clockwise direction, and this action winds-up the spring 34. The lever spring, not shown, biases the lever 64 into a deployed position and the spool 20 is indexably stopped via interaction of the pawl 72 and index slots 30. The lever 64 can then be retracted via the handle 70 against the bias of the lever spring to allow the spool 20 to unwind and cord to be fed outward, as desired.

The upper and lower housing halves 12 and 16 also include an cord reeling aperture 82 for intake and deployment of cord into the device 10 which is formed by an upper aperture half 82 and lower aperture half 82'. Upon pre-winding of the spool 20 and joinder of the upper and lower housing halves 12 and 16, the tongue 50 is oriented to extend out the aperture 80. The tongue 50 is also shown to include a locking pin aperture 86, which in this instance is triangular in shape.

Figure 2:
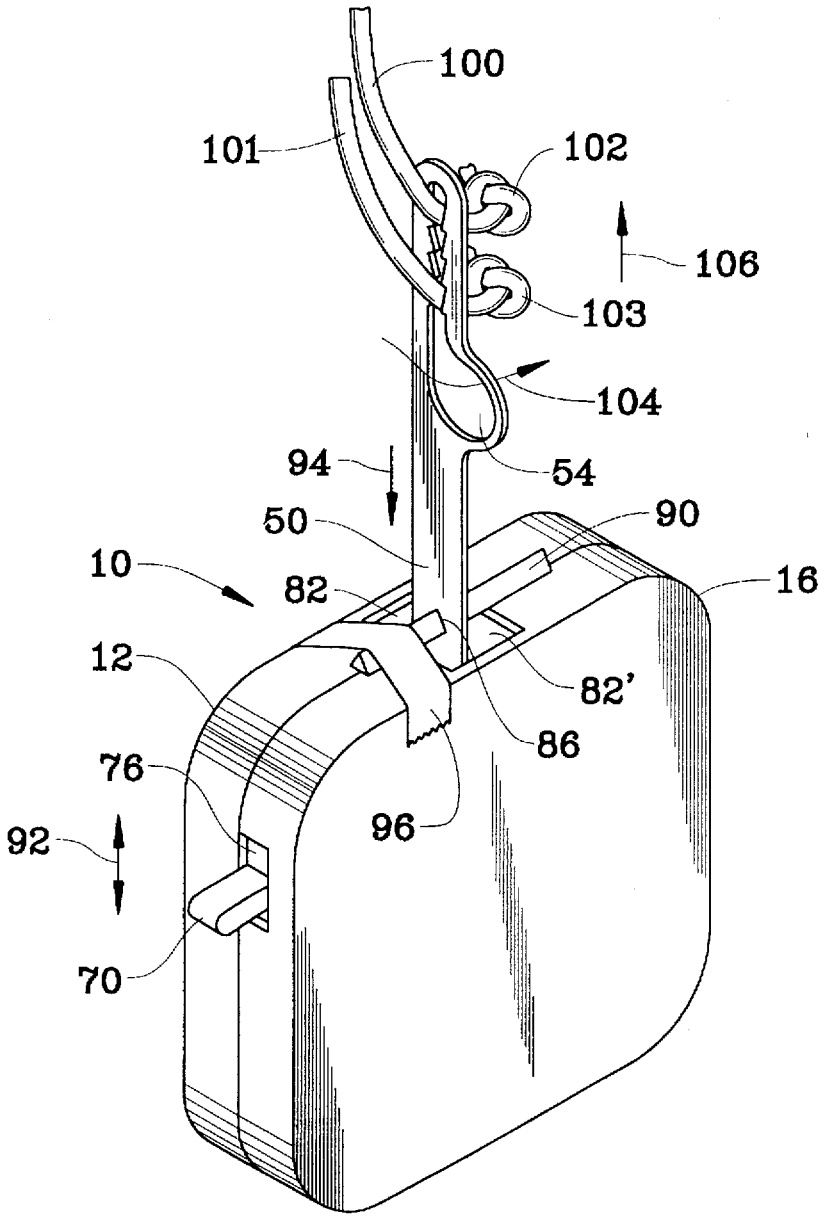
FIG. 2 is a perspective view of the assembled component parts of the automatic cord reeling device of FIG. 1.

Referring also now to FIG. 2, an assembled cord reeling device 10 is shown in its pre-wound state with a locking pin 90 inserted through the locking pin aperture 86. The upper housing half 12 is joined with the lower housing half 14 through an adhesive means. The preferred method includes a plastic welding process known as ultrasonic welding. Alternatively, snap-locking posts and/or pins might be included to provide a secure, yet non-permanent joinder of the parts 12 and 16. Yet another alternative might include screws, bolts or other external hardware attachment means, with associated receiving holes in the parts 12, 16, as used to join the parts together. The housing halves are typically formed from a hard plastic, but might also include metal, wood, or other such formable materials. The inner spool and lever might also be formed of similar or identical materials. The parts might be colored or painted to provide fashionable color choices for a consumer in order to make the device match such things as the cords, blinds, shutters, and/or drapes associated with the area of use. Side cavities, not shown, might also incorporate wood laminates which would be glued to the side of the housing to thereby match wood blinds and/or the surrounding wood of the windows or other nearby object.

The lever aperture 76 is more clearly shown in this view with the lever handle 70 extending outward for sliding operation by a user in the general direction indicated by the arrow 92. The tongue 50 is placed outside the device 10, through the cord reeling aperture 82, so that the locking pin aperture 86 is exposed. The tension of the wound spring 34 (see FIG. 1) biases the tongue 50 to be drawn inward as shown by arrow 94. The spring biased lever 64 will prevent further unwinding of the spool 20, as described above. It is important to present the cord reeling device in a preloaded condition for automatic winding of the cords. Accordingly, the triangular shaped locking pin 90 is inserted through the triangular aperture 86. Since the pin 90 is generally larger than the cord reeling aperture 82, the locking pin would be drawn against the cord reeling aperture 82 by the spring retraction pressure being exerted on the tongue 50, if for instance the lever 64 is disengaged from the spool 20.

The locking pin 90 can also be tapered so that it can be more securely lodged into aperture 86 without the pin slipping out. As a further precaution, strips of tape 96 or the like can be placed over the locking pin 90 and hold it into place against the housing of the device 10. The tape strips 96 might also include warning messages which warn and instruct the user on how to use the winding device. If the pin is mistakenly pulled or dislodged, the pre-wound energy in the spring 34 will be dispelled and the unit will either have to be replaced or manually re-wound. The difficulty of such an operation will depending upon the adhesive means used to join the housing components together. The taped locking pin and spring-biased lever, with the exposed slotted tongue for automatic loading of the cords, however, presents a unique solution to prevent such mishaps from occurring.

As further shown in FIG. 2, a knot 102 is tied in the end of a cord 100. The knot 102 is fed through the cord receiving aperture 54 as shown by arrow 104. The cord 100 is then slid distally along tongue 50 and into the serrated slot 58 as shown by arrow 106. A second cord 101 and knot 103 are also shown as placed in the tongue 50. The knots 102 and 103 cannot be pulled back through the slot because of their size in relation to the slot 58. The length of the slot 58 also allows for insertion of more than one cord which is thereafter coiled onto the spool 20. Once the cords are loaded into the tongue, the lever 64 is disengaged and the locking pin 90 is removed from the aperture 86, and the pre-wound energy in the spring 34 serves to wind the cords inside the device 10 to a predetermined length.

Such cords 100, 101 for blinds and shutters are typically 1/16 inch in diameter and the amount of cord that can be handled by the cord reeling device 10 is a direct function of the diameter of the cord and the number of cords that are fed into the tongue. The embodied device has been pre-wound and sized so that it will reel in approximately 8 feet of 2 cords placed within the tongue. Alternatively, this same pre-winding level and device size will handle approximately 6 feet of 3 cords placed within the tongue. The embodied device also uses approximately 25 turns of pre-wound energy in the spool. It would be a straightforward variation to accommodate other thicknesses and numbers of cords as needed with a larger spool, a larger reeling device, and/or a tighter pre-winding on the spool.

Moreover, the cord winding device 10 can easily be reused or moved from one location to another by retracting the cords 100, 101 fully and thereby re-exposing the tongue 50. The lever 64 would hold the newly-rewound spool 20 in place, and the locking pin 90 could be reinserted through the aperture 86 to prevent accidental retraction of tongue 50. Tape 96 might also be used, as described above. The cords can then be removed arid the device 10 reloaded with other cords at a different location for retraction of storage of the newly loaded cords.

Figure 3:
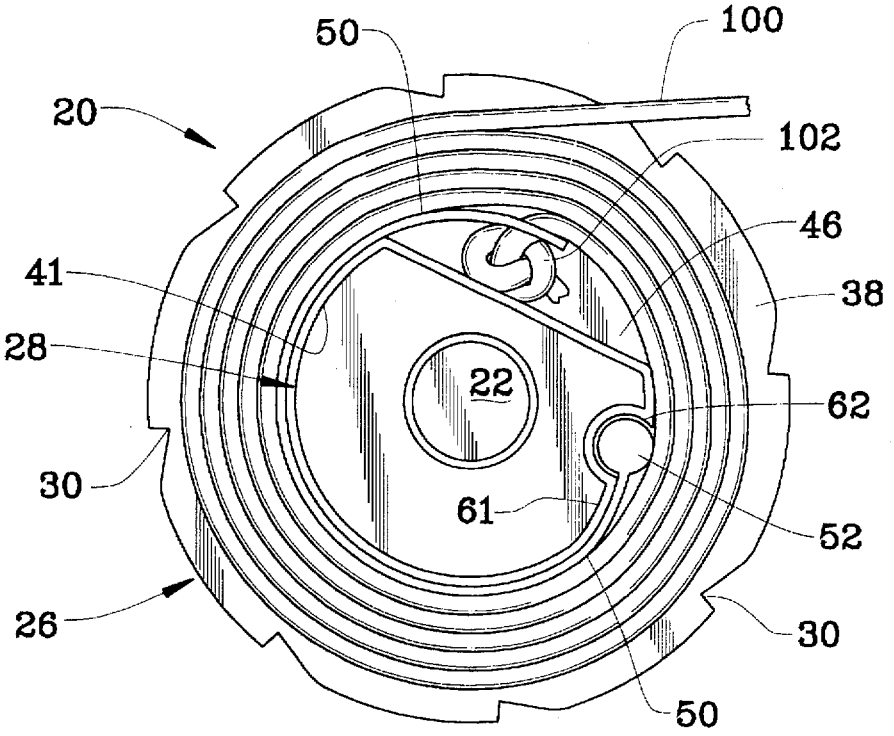
FIG. 3 is a top view of the inner spool of the automatic cord reeling device of FIG. 1.

Referring also now to FIG. 3 a view of the upper surface 38 of the inner spool 20 is shown. Again, the central hub 28 includes a disk 26 on the lower portion of the spool 20 and a walled fixture 41 on the upper portion of the spool 20. The ledge 46 is more clearly shown as formed along the flat portion of the "D"-shaped wall 41. Aperture 62 is formed within a portion of the wall 41 for receiving tongue 50, shown below. As the spool 20 unwinds in a counterclockwise direction, the tongue 50 wraps around wall 41 with mounting fixture 52 pivoting inside aperture 62. The wall 41 includes an inward taper 61 to accommodate wrapping of the tongue 50 around the wall 41. The end of the tongue 50 wraps around so that knot 102 rests on the ledge 46. This provides a more even coiling of the cords around the hub 28 and wall 41 without interference from the knots, as further discussed below.

Figure 4:
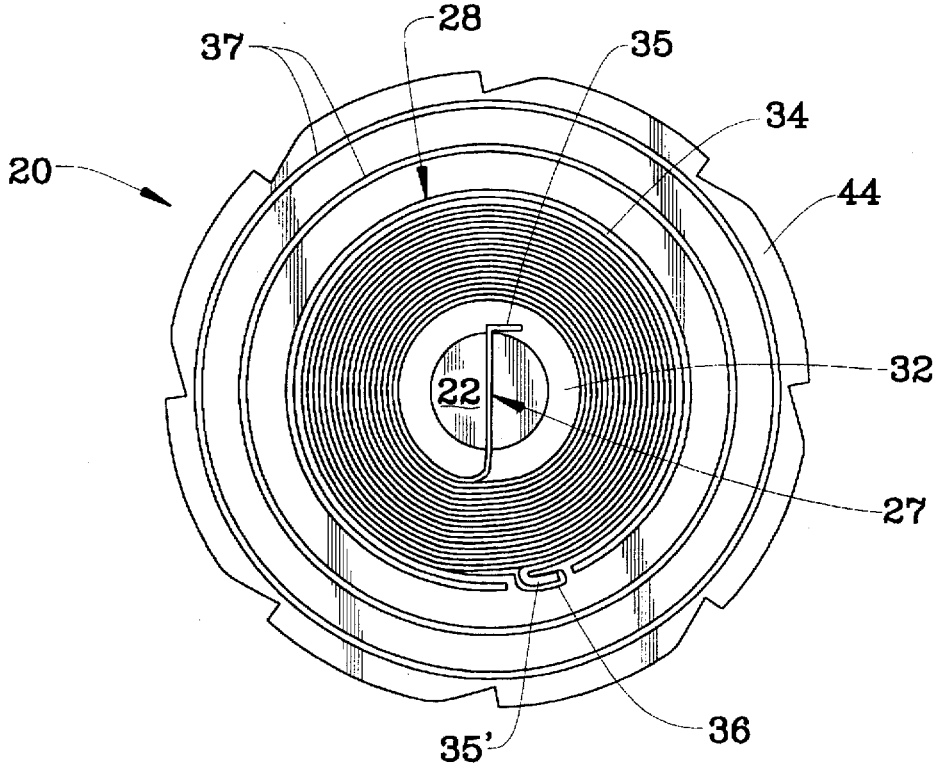
FIG. 4 is a bottom view of the inner spool of the automatic cord reeling device of FIG. 1.

Referring also now to FIG. 4, a view of the bottom surface 44 of the inner spool 20 is shown. The inner cylindrical cavity 32 extends upward into the central hub 28 and receivably contains the coiled spring 34, with the spring 34 is shown in its unwound state. The L-shaped slot 36 contains one bent end 35' of the coiled spring 34 which is slidably inserted into the slot 36 as the spring 34 is inserted into the cavity 32. The other end 27 of the spring 34 is bent to extend across the aperture 22, and is then bent into a L-shape 35. The bottom surface 44 additionally includes a series of circumferential rings or ridges 37 which serve as bearings for the rotating spool 20 against the flat lower surface of the housing cavity 18. Without such bearing rings 37, the friction between the rotating spool 20 and the cavity 18 might become prohibitive and retard rotation of the spool 20. The spring end 27 thereby fits into slot 25 on spindle 24 (See FIG. 1) as the spool 20 is placed into housing cavity 18.

Hence in operation, and referring to the Figures collectively, the spool 20 is wound clockwise a fixed number of turns and assembled with the tongue 50 extending from the aperture 82, 82'. The knotted cords 100, 101 are placed in the tongue and are slid into the serrated slot 58 on the tongue 50. After the cords are loaded as described the lever 64 is retracted, and the tape 96 and locking pin 90 are removed. When the spool 20 spins counter-clockwise in response to the tension on spring 34, tongue 50 wraps around the curved portion of the "D"-shaped wall 41. Tongue 50 is formed to be long enough so that the tongue wraps fully around wall 41, with the slot 58 positioned over the ledge area 46. The knots 102 (and knot 103 not shown in FIG. 3) are then wound around to their storage position along the flat portion of the wall 41 and on top of ledge 46. This arrangement provides for smoother winding of the cords on the spool 20 because the bulk of the knots is accommodated via a storage position for the knots on ledge 46. This prevents tangling of the knots with the subsequently wound cords. Once initially wound into the cord reeling device, the length of the exposed cords can be controlled via the spring-biased indexing lever 64 which ratchets against the inner spool.

While the embodied invention has been described in terms of providing a cord reeling apparatus for excess cords which might extend from a window blind or window shade, the disclosed apparatus is also intended to be used as an automatically loading and pre-wound reeling device for other corded devices and appliances. Additionally, while a locking pin which is placed through a locking pin aperture in an exposed tongue device is shown in this embodiment, the invention is also intended to include other locking means and devices which would serve to hold an exposed cord attachment device, outside the reel housing until the cords have been attached. The locking means or device would then be disengaged or removed and the automatic loading principles of this invention, as facilitated by the pre-wound device presented herein, would be similarly accomplished.

Hence, it is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A cord reel apparatus for automatic loading of at least one cord therein, said apparatus comprising:

a reel housing including a spool cavity and a cord reeling aperture;

a spool rotatably contained within said spool cavity;

a spring means coupled to said spool which is pre-wound a fixed number of turns to provide a pre-wound spool;

a cord attachment device connected to said pre-wound spool having a cord attachment means for attaching a cord, said cord attachment means accessibly exposed outside said cord reeling aperture in said reel housing; and a releasable locking means for engaging said exposed cord attachment device;

whereby said cord is attached to said exposed cord attachment means and said locking means is thereafter released causing said pre-wound spool to unwind and reel said attached cord into said reel housing and onto said spool.

2. The cord reel apparatus of claim 1, wherein said apparatus further includes a slidable lever with a handle and a pawl, said spool having indexing slots, said housing having a lever handle aperture and a lever slot, said lever slidably placed in said lever slot with said lever handle extending from said handle aperture and said pawl interacting with said indexing slots.

3. The cord reel apparatus of claim 2, wherein said apparatus further includes a lever spring means for biasing said pawl into said indexing slots.

4. The cord reel apparatus of claim 1, wherein said cord attachment device includes a flexible tongue with a distal and proximal end.

5. The cord reel apparatus of claim 4, wherein said flexible tongue is formed from nylon.

6. The cord reel apparatus of claim 4, wherein said cord attachment means includes a cord attachment aperture and a connected distally extending cord attachment slot formed through said distal end of said tongue.

7. The cord reel apparatus of claim 6, wherein said slot includes serrated edges.

8. The cord reel apparatus of claim 6, wherein said spool includes a centralized hub with an upper and lower end, said lower end including an disk with an indexably slotted edge, said upper end including a ledge formed on one side of said hub, whereby said tongue wraps around said hub and said cord attachment slot is placed over said ledge.

9. The cord reel apparatus of claim 4, wherein said releasable locking means includes an locking pin aperture formed through said tongue between said proximal and distal ends, and a locking pin, which fits into said locking pin aperture, whereby said locking pin fits into said locking pin aperture of said exposed tongue and prevents withdrawal of said tongue through said cord reeling aperture.

10. The cord reel apparatus of claim 9, wherein said locking pin is tapered to frictionally fit within said locking pin aperture.

11. The cord reel apparatus of claim 10, wherein said locking pin is triangular in shape.

12. The cord reel apparatus of claim 9, wherein said locking pin is detachably secured to said reel housing.

13. The cord reel apparatus of claim 4, wherein said proximal end of said tongue includes an attachment fixture and said spool includes a corresponding receiving aperture for attaching said tongue to said spool.

14. The cord reel apparatus of claim 1, wherein said reel housing includes an upper housing half joined with a lower housing half with said spool cavity formed there between, said spool including a central mounting aperture and said spool cavity including a corresponding spindle, said spring means including a coiled band of flexible material coupled to said spool and said spindle.

15. A cord reel apparatus which provides for automatic loading of at least one cord therein, said apparatus comprising:

a reel housing including a spool cavity, a cord reeling aperture, and an lever slot, and lever handle aperture;

a spool having an indexably slotted disk and a hub with a ledge formed along one side, said spool rotatably contained within said spool cavity, and a spring means coupled to said spool which is pre-wound a fixed number of turns to provide a pre-wound spool;

an indexing lever with a handle and a pawl, said indexing lever slidably contained within said lever slot along with a lever spring means, said handle projecting through said lever handle aperture with said pawl biased to interact with said index slots on said disk;

a cord attachment device connected to said pre-wound spool including a flexible tongue having a proximal and distal end and including a cord attachment aperture and distally extending cord attachment slot formed therethrough which is accessibly exposed outside said cord reeling aperture in said reel housing; and a releasable locking mechanism for engaging said exposed cord attachment device including a locking pin aperture formed through said tongue between said proximal and distal ends, and a locking pin for insertion through said locking pin aperture;

whereby said cord is attached to said exposed portion of said tongue and said locking pin is thereafter removed causing said pre-wound spool to unwind and reel said attached cord into said reel housing and onto said spool.

16. The cord reel apparatus of claim 15, wherein said cord attachment slot is serrated to prevent slippage of cords placed therein.

17. A cord reeling method which provides for automatic loading of at least one cord within a cord reeling apparatus of claim 15, said method including the steps of:

tying a knot in the end of each said cord to be used with said apparatus;

placing said knot through said cord attachment aperture and sliding said cord distally into said cord attachment slot;

removing said locking pin and allowing said pre-wound spool to reel-in said attached cords into said reel housing;

controlling the length of said exposed cords with said indexing lever.

* * * * *